United States Patent [19]

Spinosa et al.

[11] 3,994,666

[45] Nov. 30, 1976

[54] FIRE START UNIT

[75] Inventors: Dominic Joseph Spinosa, Wantagh; George Skridul, Huntington, both of N.Y.

[73] Assignee: East/West Industries, Inc., Farmingdale, N.Y.

[22] Filed: Dec. 15, 1975

[21] Appl. No.: 640,433

[52] U.S. Cl. ..... 431/144; 431/276

[51] Int. Cl.² ..... F23Q 1/06

[58] Field of Search ..... 431/127, 144, 146, 273, 431/276, 287; 110/1 F

[56] References Cited

UNITED STATES PATENTS

| | | | |
|---|---|---|---|
| 1,394,487 | 10/1921 | French | 431/273 |
| 2,107,546 | 2/1938 | Purdy et al. | 110/1 F |
| 2,462,467 | 2/1949 | Clamp | 431/276 |
| 2,847,843 | 8/1958 | Greenhouse et al. | 431/276 |

*Primary Examiner*—Carroll B. Dority, Jr.

[57] ABSTRACT

A fire start unit having all the necessary elements for creating a flame to ignite a material such as wood. The unit includes hollow housing means with removable closure means at each end of the housing means with igniter means manually operated by the user at one end of the housing means to create a spark after the safety means has been removed. Contained within the hollow casing at the opposite end is removable tinder means consisting of a first flame means and a second flame means. The unit in operational use ignites the first flame means by a spark generated by the igniter means which in turn ignites the second flame means.

45 Claims, 7 Drawing Figures

FIG. 3
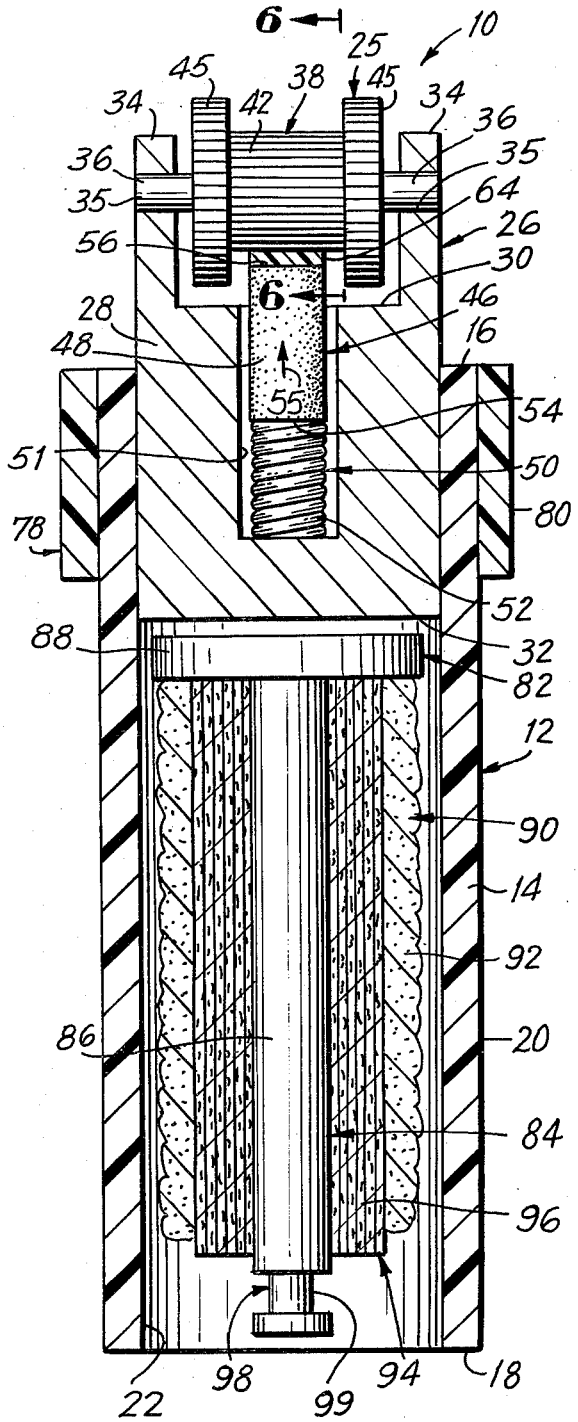
FIG. 4
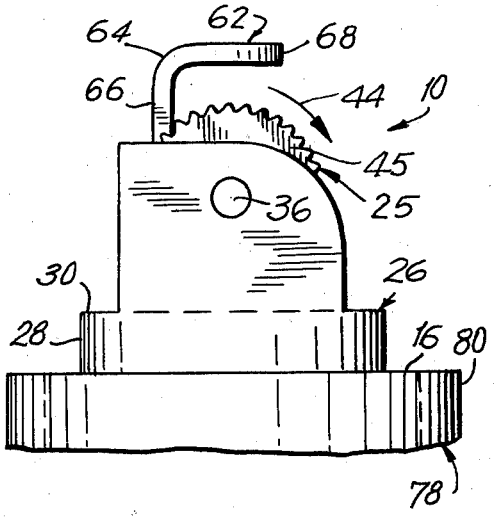
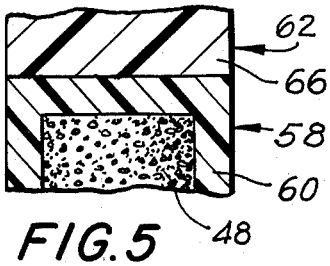
FIG. 5
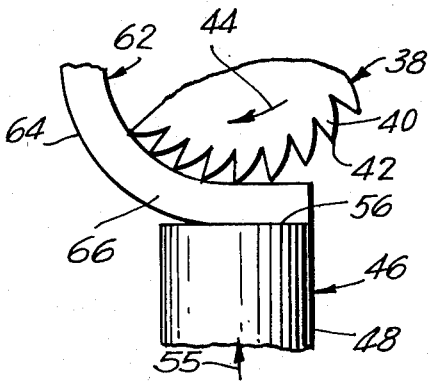
FIG. 6

FIRE START UNIT

BACKGROUND OF THE INVENTION

The invention relates generally to a fire start unit and more particularly to a self-contained package that is easily and quickly opened and includes the necessary components to create the spark and material for starting a fire and sealed for long-term storage and easy to use.

The need to create a fire by both civilians and military personnel is well-known. The civilian may be a camper, or stranded individual resulting from a variety of reasons such as an airplane crash, etc. The miliatry reasons may be due to accidents leaving one or more individuals in a stranded area. In many instances the implements used to create the flame must be stored for prolonged periods of time, yet when called for must be "fail safe" since the prospective user's life may well depend on the unit functioning. In military applications the first start unit may form part of a survival kit for emergency use.

The fire start unit must also be adapted for all sorts of storage conditions and be functional in all climatic conditions which may be in the temperature range from −65° to 165° F. It should be pointed out that even matches under certain conditions can self-ignite, and if moistened can fail to ignite. Propane, which is the fuel for most lighters, under adverse conditions is explosive and has certain inherent dangerous hazards. The present invention overcomes these problems by precluding any elements which by their interrelationship and design features self-ignite or fail to ignite upon use.

OBJECTS OF THE INVENTION

An object of the present invention is to provide an improved fire starting device which is easily and quickly opened and used under a variety of environmental conditions.

Another object of the present invention is to provide an improved fire starting unit easily storable in a survival kit.

Another object of the present invention is to provide a fire start unit which includes means for creating the spark and the material to ignite contained therein.

Another object of the present invention is to provide a fire start unit which is weather proof, fracture resistant, lightweight, non-distorting, and capable of long term storage and stable under various environments.

Other objects of the present invention will become apparent as the disclosure proceeds.

SUMMARY OF THE INVENTION

The present invention provides a fire start unit and kit that includes housing means that may be constructed of a high impact clear plastic housing with removable closure means at each end when in storage. An igniter means or assembly is mounted at one end of the housing means for the purpose of creating the spark. Indicia means that may be in the form of a colored band that denotes the igniter end of the housing means is mounted on the housing means.

The opposite end of the housing means contains supporting means, having first flame means in the form of cotton and second flame means in the form of wax impregnated paper mounted therein. The cotton tinder and the wax impregnated paper are loaded into the housing means around the supporting means, making it easily removable, when required.

The cotton tinder is used as the first flame means for the initial ignition due to its low flash point and the waxed impregnated paper acts as the second flame means, like a wick which provides the longer lasting flame to ignite the wood or other materials being burned to continue the fire.

Both ends of the housing means are sealed by closure means using plastic end caps which provide protection of the total assembly. The igniter assembly is comprised of the following basic parts; spark wheel, flint, and compression spring. These components utilize the plastsic housing for its simplicity of design. The igniter means has a set of tabs which positions the spark wheels and friction means therebetween. It is pinned through the ears so that its axis of rotation is perpendicular to that of the flint. The shape and position of these tabs are such that it permits rotation of the spark wheels and friction means.

The flint is protected with a special coating to ensure its ability to withstand long-term storage and environmental protection. The flint is located in a pocket under the spark wheel and has a positive loading applied due to the action of the compression spring. To ensure that the coating at the end of the flint is undisturbed and the flint protected until ready for use, a plastic safety-tab is installed between the friction means and flint. At first use, the tab is removed by pulling or it may be slid out of position by the rotation of the spark wheel. The friction means is then free to cut through the flint coating to create the necessary spark. All metal parts are made from corrosion-resistant steel to provide full environmental protection and life. Its single rugged housing contains both the fire start and tinder sections.

The present invention permits one hand to be used to start a fire, an important feature for flight or other personnel who may have sustained an arm injury. The igniter means produces an immediate spark and the cotton tinder does not rely on the storage or pressurized gases or volatile liquids, a distinct safety feature. The complete fire start unit may be approximately ⅝ inch in diameter by 3 inches long and weighs less than 1 ounce.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 3 is a longitudinal view, partly in section, with the end closures removed, through the fire start unit made in accordance with the present invention showing the positions of the parts within the housing prior to use, taken along line 3—3 of FIG. 2;

FIG. 4 is a partial side view of the unit illustrated in FIG. 3;

FIG. 5 is an enlarged fragmentary view illustrating the coating of the flint;

FIG. 6 is an enlarged fragmentary side view of the friction means relative to the flint, taken along line 6—6 of FIG. 3.

PREFERRED EMBODIMENT OF THE INVENTION

Figure 1:
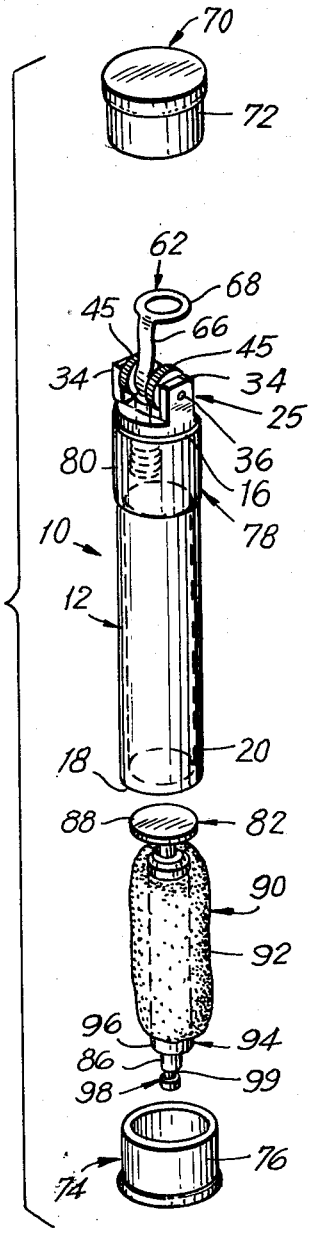
FIG. 1 is an explosive view showing the various cooperating aspects of the fire start unit.
Figure 2:
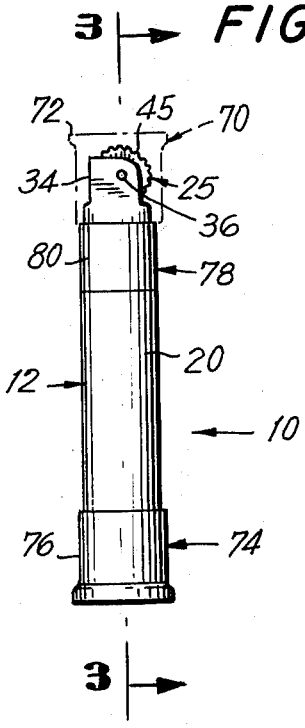
FIG. 2 is a side view of the fire start unit in its assembled position.

In accordance with the invention and as illustrated in FIGS. 1–7, the fire start unit 10 includes housing means 12 which may have a variety of configurations but is illustrated as being of a tubular configuration having a wall 14 that extends from the upper or top end 16 to the lower or bottom end 18 of the housing means 12. The housing means 12 may be made out of a plastic material having an outer wall surface 20 and inner wall surface 22 and if desired may be transparent as an aid to view the contents thereof for visual inspection of the contents.

The igniter means or assembly 25, which is responsible for creating the spark necessary to ignite the cotton tinder which in turn ignites the wax impregnated paper, is mounted at the upper end 16 of the housing means 12. The igniter assembly 25 includes mounting means 26 having a base 28 with an exposed or upper surface 30 and bottom surface 32 contained within the housing means 12. The base 28 as seen in FIG. 3 is positioned in telescopic relation with the inner wall 22 of the housing means 12 and may be secured thereto by pinning, adhesive, pressfit, etc. The mounting means 26 includes a pair of spaced apart tabs or ears 34 extending upwardly from the top 30 of base 28 with a transverse aperture 35 extending through each tab 34 with shaft 36 extending transversely therethrough. Mounted on the shaft 36 is friction means 38 which may be in the form of an element 40 having a knurled friction surface or projections 42. The projections 42 may be tapered such that the spark is created only when the friction meanas 38 is rotated in one direction as indicated by arrow 44 as illustrated in FIG. 6. The projections 42 are inclined for friction engagement as the friction means 38 is rotated toward the user. A pair of spacer apart thumb wheels 45 are secured in a conventional manner to the shaft 36 with the friction means 38 mounted therebetween to create the spark.

The igniter means 25 further includes spark means 46 in the form of a flint 48 which is positioned in a cavity 50 in base 28 surfacing at the upper surface 30. The flint 48 is maintained under compression against the friction spark means 38 by compression means 50 illustrated in the form of a compression spring 52 that is contained within the cavity 51 to apply the upward pressure against the bottom 54 of the flint 48 such that the top 56 of the flint 48 engages the friction element 40 and is maintained under compression until such time as the fire start unit 10 is desired to be used.

As illustrated, the axis of rotation of the shaft 36 is perpendicular to that of the flint 48. Furthermore, the shape of the projections 42 are such that generation of a spark occurs in only one direction. To ensure proper storage of the unit 10 prior to use, as illustrated in FIG. 5, the flint 48 has protective means 58 associated therewith which may be in the form of a special coating 60 to ensure its ability to accommodate long-term storage and environment protection. The coating 60 does not have to be physically removed in that engagement with the projections 42 is sufficient to cut through the coated surface. Accordingly, the compression spring 52 is located in the base 28 under the flint 48 and applies a constant force in the direction of arrow 55 against spark friction means 38.

Safety means 62 is provided to ensure that the coating 60 at the upper end 56 of the flint 48 is not disturbed and the flint 48 is protected until ready for use. The safely means 62, as particularly seen in FIGS. 1, 4 and 6, may be in the form of a safety-tab 64 installed between the spark friction means 38 and the flint 48. The safety tab 64 may be made of a plastic material. At first use, the tab 64 is removed by pulling or it may be slid out of position by the rotation of the thumb wheels 45 which also rotate the spark friction means 38. The tab 64 has a body portion 66 positioned between the flint top 56 and the projections 42 with an integrally formed head portion 68 which may be grasped by the user for removal from the sandwiched position prior to use of the unit 10.

In the stored position upper closure or cover means 70 is provided which may be in the form of an end cap or closure 72 made of plastic or some other material that snugly fits over the upper end 16 of housing means 12 is provide a protective closure therefore. In a similar manner lower closure means 74 is provided which similarly may be made of an end cap 76 of a plastic material to enclose the lower end 18 of the housing means 12 to make the unit 10 moisture resistant.

To distinguish one end of the unit from the other end indica means 78 is provided and in accordance with the illustrated embodiment of the invention, a band 80 situated proximate the upper end 16 of the housing means 12 is provided. The indicia means 78 may be of a particular color or having writing thereon indicating that the igniter means 25 is located at this end of the unit 10. If desired, the indicia means 78 may be positioned on the upper closure means 70, or lower closure means 74, with distinctive writing thereon to provide for the user which end should be opened first in use of the unit 10, as well as operational instructions if desired.

The unit 10 further includes tinder means 82, necessary to produce an immediate flame, stored within a storage chamber contained within the housing means 12. The tinder means 82 includes supporting means 84 having a shaft or rod 86 with a disc or enlarged head 88 at one end thereof. When stored within the storage chamber of the housing means 12 the tinder means 82 is completely contained therein in the chamber or compartment formed between the bottom surface 32 of the base 28 of the mounting means 26 and the lower end 18 of the housing means 12.

The tinder means 82 further includes first flame means 90 in the form of cotton or equivalent 92 and second flame means 94 in the form of wax impregnated paper 96 or equivalent, positioned in surrounding relation to the rod 86 during storage. As seen in FIG. 3, the wax impregnated paper 96 can be rolled on rod 86 so that it is contained thereon during storage and may be easily removed for creating the flame as diagramatically set forth in FIG. 7. Surrounding the wax impregnated paper 96 is the cotton tinder 92 which can be packed around the wax impregnated paper 96 for storage until use is required.

Gripping or tinder extractor means 98, as seen in FIG. 3, is provided to facilitate the user removing the tinder means 82 from its position within the housing means 12. Particularly it is important to permit the user, since the unit 10 may be used in a very cold climate, to easily grip and remove the tinder means 82 so that operation of the unit 10 may be facilitated. Towards this end, the tinder extractor means 98 may be in the form of an indent or depression 99 provided around the bottom end of the rod 86 so that the fingers of the user may grip the rod 86 and remove the tinder means 82 from the housing means 12 when use is required.

Figure 7:
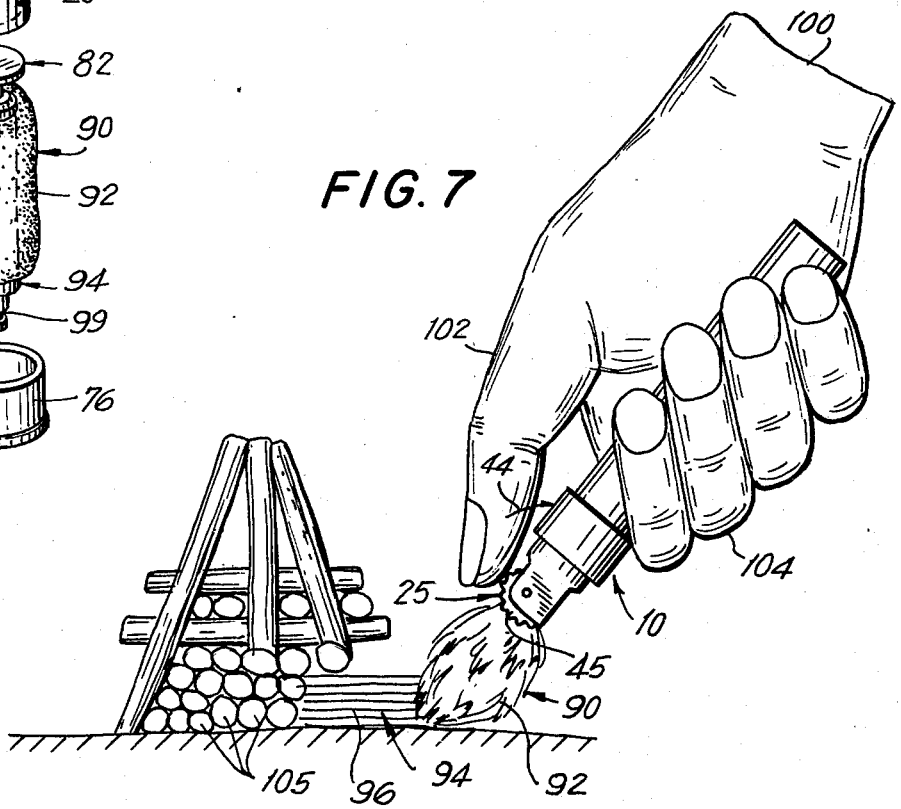
FIG. 7 is a diagrammatic view illustrating the fire start unit in operational use by a user.

FIG. 7 is helpful in illustrating the unit 10 in use by indicating that the user would first remove the upper closure means 70 and the lower closure means 74. The indicia means 78 may be read by the user to determine which end has the igniter means 25 and the tinder means 82. The tinder means 82 is then removed from within the housing means 12 by the user gripping the extractor means 98 and sliding the supporting means 84 axially outwardly from its telescopic relation with the housing means 12. The first flame means 90 in the form of cotton 92 is removed from its surrounding relation with the second flame means 94 in the form of the wax impregnated paper 96. The safety tab means 62 is then removed by the user gripping the head portion 68 such that the body portion 66 of the tab 64 is removed from its position and the igniter means 25 is operational. To create the spark the user 100 places his thumb 102 on the thumb wheels 45 and his other fingers 104 are placed around the housing means 12. The igniter means 25 creates the necessary spark to ignite the cotton 92 which in turn ignites the wax impregnated paper 96 and then the other medium 105, such as wood, that one desires to burn to create a fire for both warmth and other obvious reasons. Accordingly, the unit 10 is in effect a complete kit containing all the ingredients necessary and working in combination with each other for the user 100 to be able to create a flame when and where desired. By not relying on any gas in order to create the flame, the temperature range in which the user can operate the unit is expanded in that under certain cold condiditons a gas operated unit would not function.

The present invention provides a new and novel device permitting long-term storage prior to use and yet essential reliability under all environmental conditions. The metal parts from the igniter means 25 may be made from corrosion resistant steel to provide full environmental protection and life. As illustrated in FIG. 7, it is possible for the user 100 in merely using one hand to start a fire. This is a most important feature for an individual who might have sustained a hand injury or may be using the other hand for another purpose while simultaneously trying to create the flame. The compactness of the unit is such that it can be manufactured in a size of approximately ⅝ inches in diameter, 3 inches long and can weigh less than 1 ounce.

Although an illustrative embodiment of the invention has been described in detail herein with reference to the accompanying drawing, it is to be understood that the invention is not limited to that precise embodiment, and that various changes and modifications may be effected therein without departing from the scope or spirit of the invention, except in the appended claims.

We claim:

1. A fire start unit, comprising:

A. housing means adapted to be hand held during usage of the fire start unit,

B. igniter means mounted at one end of said housing means and including:

a. a flint, b. friction means adapted for engagement with said flint, c. a wheel mounted for movement of said friction means relative to said flint, d. means for compressing said flint against said friction means, wherein movement of said wheel generates a spark, C. first closure means mounted in removable relation to said housing means for enclosing said igniter means when said first start unit is stored, D. tinder means stored in said housing means for use in conjunction with said igniter means for creating a flame in starting a fire, said tinder means including:

a. supporting means including a shaft adapted to axially extend freely within the other end of said housing means, b. first flame means of solid combustible material, c. second flame means of a solid combustible material of a different composition from said first flame means, both of said flame means surrounding said suporting means with said first flame means ignited by said igniter means and said second flame means ignited by said first flame means, and E. second closure means mounted in removable relation to said housing means for enclosing said tinder means when said first start unit is stored.

2. A fire start unit as defined in claim 1, and further including indicia means contained on said housing means to indicate the end of said housing means said igniter means is positioned.

3. A fire start unit as defined in claim 2, wherein said indicia means includes a band on said housing means.

4. A fire start unit as defined in claim 3, wherein said band is colored red.

5. A fire start unit as defined in claim 1, a. wherein said housing means is formed of a tubular shell open at each end, and b. wherein said igniter means is mounted at one end of said tubular shell.

6. A fire start unit as defined in claim 1, wherein said igniter means further includes mounting means secured to said housing means, said mounting means including:

a. a base, b. a pair of spaced apart tabs extending from said base, c. an aperture in each of said tabs in axial alignment with each other, d. a shaft mounted for rotational movement in said apertures, said shaft having said friction means and wheel mounted thereon, and e. a cavity in said base beneath said friction means containing said flint and said means for compressing said flint against said friction means.

7. A fire start unit as defined in claim 6, wherein said means for compressing said flint against said friction means includes a compression spring contained in said cavity.

8. A fire start unit as defined in claim 1, wherein said friction means has an exterior surface configuration adapted to frictional engage said flint to create a spark upon movement in one direction and no spark in the opposite position.

9. A fire start unit as defined in claim 1, wherein said housing means is transparent to view the contents thereof.

10. A fire start unit as defined in claim 1, wherein said supporting means includes:

a. a shaft extending axially within said housing for supporting said first flame means and said second flame means, and b. a disc mounted at one end of said shaft.

11. A fire start unit as defined in claim 1, and further including gripping means operatively associated with said supporting means to facilitate removal of said tinder means from said housing means by the user.

12. A fire start unit as defined in claim 11, a. wherein said supporting means includes a shaft extending axiallly within said housing means for supporting said first flame means and said second flame means; and b. wherein said gripping means includes a depression on said shaft adapted to be engaged by the fingers of the user so that the tinder means may be removed from said housing means for use thereof.

13. A fire start unit as defined in claim 1, a. wherein said igniter means further includes mounting means secured to said housing means, said mounting means including:

i. a base, ii. a pair of spaced apart tabs extending from said base, iii. an aperture in each of said tabs in axial alignment with each other, iv. a shaft mounted for rotational movement in said apertures, said shaft having said friction means and a wheel mounted thereon for engagement by the user, and v. a cavity in said base beneath said friction means containing said flint and said means for compressing said flint against said friction means, and b. wherein said supporting means includes:

i. a shaft extending axially within said housing for supporting said first flame means and said second flame means, and ii. a disc mounted at one end of said shaft.

14. A fire start unit as defined in claim 13, and further including gripping means on said shaft to facilitate removal of said tinder means from said housing means by the user.

15. A fire start unit as defined in claim 1, and further including safety means extending between said flint and said friction means in the stored position of the unit, said safety means being removable by the user prior to use of the unit.

16. A fire start unit as defined in claim 15, wherein said safety means is a tab adapted to be removed from its position by rotation of said friction means.

17. A fire start unit as defined in claim 15, wherein said safety means extends beyond said igniter means and may be grasped by the user for operation of said igniter means.

18. A fire start unit as defined in claim 1, and further including protective coating means on said flint, said coating means being removable by said friction means at the interface therebetween by rotation of said friction means relative to said flint.

19. A fire start unit as defined in claim 1, wherein one of said flame means is wound around said supporting means and the other flame means is packed around the prior flame means.

20. A fire start unit, comprising:

A. housing means adapted to be hand held during usage of the fire start unit, and having a storage chamber contained therein, B. igniter means mounted at one end of said housing means and including:

a. mounting means including a base secured to one end of said housing with a cavity contained therein, b. a flint positioned in said cavitiy, c. a pair of spaced apart tabs extending from said base, d. an aperture in each of said tabs in axial alignment with each other, e. a shaft mounted or rotational movement in said apertures, f. friction means adapted for engagement with said flint mounted on said shaft, g. a wheel mounted on said shaft for movement of said friction means relative to said flint, and h. means in said cavity for compressing said flint against said friction means, wherein movement of said wheel generates a spark, C. first closure means mounted in removable relation to said housing means for enclosing said igniter means when said fire start unit is stored, D. tinder means stored in said housing means for use in conjunction with said igniter means for creating a flame in starting a fire, said tinder means including:

a. supporting means adapted to axially extend within the other end of said housing means, said supporting means including a shaft extending axially and freely in said storage chamber, b. first flame means of solid combustible material, c. second flame means of a solid combustible material of a different composition from said first flame means, both of said flame means being wound around said shaft with said first flame means ignited by said igniter means and said second flame means igntied by said first flame means, d. gripping means operatively associated with said shaft to facilitate removal of said tinder means from said housing means by the user, E. second closure means mounted in removable relation to said housing means for enclosing said tinder means when said fire start unit is stored, and F. indicia means contained on said housing means to indicate which end of said housing means said igniter means is positioned.

21. A fire start unit as defined in claim 20, wherein said indicia means includes a band on said housing means.

22. A fire start unit as defined in claim 20, wherein said gripping means includes a depression on said shaft to be engaged by the fingers of the user to facilitate removal of said tinder means.

23. A fire start unit as defined in claim 20 wherein said means for compressing said flint against said friction means includes a compression spring contained in said cavity.

24. A fire start unit as defined in claim 20, wherein said friction means has an exterior surface configuration adapted to frictionally engage said flint to create a spark upon movement in one direction and no spark in the opposite position.

25. A fire start unit as defined in claim 20, wherein said housing means is transparent to view the contents thereof.

26. A fire start unit as defined in claim 20, wherein said first flame means is cotton.

27. A fire start unit as defined in claim 26, wherein said second flame means is composed of a wax impregnated paper.

28. A fire start unit as defined in claim 27, wherein said wax impregnated paper is wound around said shaft and said cotton extends within said housing and is packed around said wax impregnated paper.

29. A fire start unit as defined in claim 20, wherein one of said flame means is wound around said shaft and the other flame means is packed around the prior flame means.

30. A fire start unit, comprising:

A. housing means adapted to be hand held during usage of the fire start unit and having a storage chamber contained therein, B. igniter means mounted at one end of said housing means and including:

a. mounting means including a base secured to one end of said housing with a cavity contained therein, b. a flint positioned in said cavity, c. a pair of spaced apart tabs extending from said base, d. an aperture in each of said tabs in axial alignment with each other, e. a shaft mounted for rotational movement in said apertures, f. friction means adapted for engagement with said flint mounted on said shaft, said friction means having an exterior surface of spaced apart projections adapted to frictionally engage said flint to create a spark upon movement in one direction and no spark in the opposite direction, g. a pair of wheels mounted on said shaft on each side of said friction means for movement of said friction means relative to said flint, and h. means in said cavity in the form of a spring for compressing said flint against said friction means, wherein movement of said wheels generates a spark, C. first closure means mounted in removable relation to said housing means for enclosing said igniter means when said fire start unit is stored, D. tinder means stored in said housing means for use in conjunction with said igniter means for creating a flame in starting a fire, said tinder means including:

a. supporting means including a shaft extending axially in said storage chamber, b. first flame means of solid combustible material, c. second flame means of a solid combustible material of a different composition from said first flame means, both of said flame means being wound around said shaft with said first flame means ignited by said igniter means and said second flame means ignited by said first flame means, d. gripping means operatively associated with said shaft to facilitate removal of said tinder means from said housing means by the user, said gripping means including a contoured configuration on said shaft graspable by the user located beyond said flame, means, E. second closure means mounted in removable relation to said housing means for enclosing said tinder means when said fire start unit is stored, F. indicia means contained on said housing means to aid the user in operation of said fire start unit, and G. safety means extending between said flint and said friction means in the stored position of the unit, said safety means being removable by the user prior to use of the unit.

31. A fire start unit as defined in claim 30, and further including protective coating means on said flint, said coating means being removable by said friction means at the interface therebetween by rotation of said flint means relative to said flint.

32. A fire start unit as defined in claim 30, wherein said safety means is adapted to be removed from its position by rotation of said friction means.

33. A fire start unit as defined in claim 30, wherein said safety means extends beyond said igniter means and may be grasped by the user for operation of said igniter means.

34. A fire start unit as defined in claim 30, wherein said housing means is transparent to view the contents thereof.

35. A fire start unit as defined in claim 30, wherein said first flame means is cotton.

36. A fire start unit as defined in claim 35, wherein said second flame means is composed of a wax impregnated paper.

37. A fire start unit as defined in claim 36, wherein said wax impregnated paper is wound around said shaft and said cotton is packed around said wax impregnated paper.

38. A fire start unit as defined in claim 30, wherein said indicia means includes a band on said housing means.

39. A fire start unit as defined in claim 30, wherein said contoured configuration on said gripping means includes a depression on said shaft to be engaged by the fingers of the user to facilitate removal of said tinder means.

40. A fire starting kit, comprising:

A. housing means adapted to be hand held during usage of the fire starting kit and having a chamber contained therein for storing certain portions of the kit prior to use thereof, B. igniter means mounted at one end of said housing means and including:

a. mounting means, b. a flint positioned relative to said mounting means, and c. friction means supported by said mounting means and adapted for engagement with said flint, said friction means having an exterior surface of spaced apart projections adapted to frictionally engage said flint to create a spark, C. safety means extending between said flint and said friction means in the stored position of the kit, said safety means being removable by the user prior to use of the kit, D. first closure means mounted in removable relation to said housing means for enclosing said igniter means when said fire start kit is stored, E. tinder means stored in the chamber of said housing means for use in conjunction with said igniter means for creating a flame in starting a fire, said tinder means including:

a. supporting means freely mounted in said storage chamber, b. first flame means of solid combustible material, c. second flame means of a solid combustible material of a different composition from said first flame means, both of said flame means being wound around said supporting means with said first flame means ignited by said igniter means and said second flame means is ignited by said first flame means, d. gripping means operatively associated with said supporting means to facilitate removal of said tinder means from said housing means by the user, said gripping means including a contoured configuration located beyond said flame means on said supporting means graspable by the user, F. second closure means mounted in removable relation to said housing means for enclosing said tinder means when said fire start kit is stored, and G. indicia means contained on said housing means to aid the user in operation of the kit.

41. A fire starting kit as defined in claim 40, and further including protective coating means on said flint, said coating means being removable by said friction means at the interface therebetween by rotation of said flint means relative to said flint.

42. A fire starting kit as defined in claim 40, wherein said safety means is adapted to be removed from its position by rotation of said friction means.

43. A fire starting kit as defined in claim 40, wherein said housing means is transparent to view the contents of the kit.

44. A fire starting kit as defined in claim 40, wherein said first flame means is cotton.

45. A fire starting kit as defined in claim 40, wherein said second flame means is composed of a wax impregnated paper.

* * * * *